United States Patent [19]

Shimamura et al.

[11] 4,045,225

[45] Aug. 30, 1977

[54] METHOD OF FORMING A PHOTOGRAPHIC IMAGE

[75] Inventors: Isao Shimamura; Koichi Nakamura, both of Minami-ashigara, Japan

[73] Assignee: Fuji Photo Film Co., Ltd., Minami-ashigara, Japan

[21] Appl. No.: 708,248

[22] Filed: July 23, 1976

[30] Foreign Application Priority Data

July 23, 1975 Japan ..... 50-89899

[51] Int. Cl.[2] ..... G03C 5/32

[52] U.S. Cl. ..... 96/60 R; 96/22

[58] Field of Search ..... 96/60, 22, 55

[56] References Cited

U.S. PATENT DOCUMENTS

| | | | |
|---|---|---|---|
| 3,765,891 | 10/1973 | Travis | 96/55 |
| 3,820,997 | 6/1974 | Shirasu et al. | 96/60 R |
| 3,841,873 | 10/1974 | Mowrey | 96/52 |
| 3,846,130 | 11/1974 | Purol | 96/22 |

*Primary Examiner*—Mary F. Kelley

*Attorney, Agent, or Firm*—Sughrue, Rothwell, Mion, Zinn and Macpeak

[57] ABSTRACT

A method of forming an image which comprises subjecting a photographic element comprising a support and at least one photographic layer in which there is image-wise distributed a substance having a catalytic effect to image-wise intensification in the presence of a reducing agent using a solution containing: (1) at least one of hydrogen peroxide and compounds capable of releasing hydrogen peroxide or a halogenite, and (2) at least one nitro-substituted nitrogen-containing heterocyclic compound represented by the following General Formulae (I) and (II);

(I)

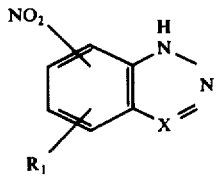

in which $R_1$ represents hydrogen atom, an alkyl group, $SO_3M$ or COOM, wherein M represents a hydrogen atom, an alkali metal or ammonium group, X represents nitrogen atom or CR', wherein R' represents a hydrogen atom or a lower alkyl group, and (II)

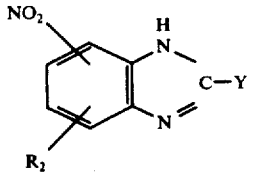

in which $R_2$ represents hydrogen atom, an alkyl group, $SO_3M$ or COOM, wherein M represents a hydrogen atom, an alkali metal or an ammonium group and Y represents a hydrogen atom, an alkyl group or $CH_2$—S—$(CH_2)_n$—Y' wherein *n* represents 1 to 3 and Y' represents a hydrogen atom or $SO_3M$.

7 Claims, No Drawings

METHOD OF FORMING A PHOTOGRAPHIC IMAGE

BACKGROUND OF THE INVENTION

1. Field of the Invention

This invention relates to a method of forming a photographic image by intensification using a halogenite, hydrogen peroxide or a compound capable of releasing hydrogen peroxide, more particularly, to a method of forming a photographic image while inhibiting fog by effecting image intensification in the presence of a nitro-substituted nitrogen-containing heterocyclic compound.

2. Description of the Prior Art

It is known that a photographic light-sensitive material using a light-sensitive metal salt can be exposed, subjected to chemical or physical development to form a catalytically active metallic image of a Group VIII, VI a or I b metal and a color image or a tanning image is oxidizingly formed in a photographic element in the presence of hydrogen peroxide or a compound capable of releasing hydrogen peroxide with a reducing agent or a reducing agent and color forming agent, as disclosed in West German Patent Applications (OLS) 1,813,920, 1,950,102, 1,995,901, 1,961,029, 2,044,833, 2,044,993, 2,056,360, 2,056,359 and 2,120,091 and Japanese Patent Applications 128,327/1974 and 139,917/1974.

In the field of color photography, with which the present invention deals, a color photographic material prepared by incorporating color formers such as cyan, yellow and magenta in a silver halide photographic emulsion by various methods and applying the emulsion to a support is subjected to image-wise exposure and then to a series of processings to reproduce the image on the photographic material.

The basic processings involved are color development processing and silver removal processing. A silver halide color photographic material is exposed and then developed with a color developing agent in the color developing processing. That is to say, the silver halide is reduced by the color developing agent to form a silver image while the color developing agent thus oxidized is reacted with the color former to give a color image. Then, the color photographic material undergoes silver removal processing, wherein the silver formed is oxidized by the action of an oxidizing agent generally called a "bleaching agent", dissolved by a compexing agent for silver ions generally called a "fixing agent" and removed from the photographic material. Thus, only the color image remains. In practical development, the above described basic processings of color development and silver removal are further accompanied by other auxiliary processings to retain the photographic and physical qualities of an image or to improve the storage capability of an image, for example, by hardening to prevent the light-sensitive film from excess softening during processing, stopping to effectively stop the development reaction, stabilizing to stabilize the image or a film removal to remove a backing layer from the support.

Since 1940, color photographic processing of this kind has commonly been carried out. A color light-sensitive material used in such color processing contains about 1 to 15 g of silver per 1 $m^2$ of the sensitive material in the form of a silver halide. For example, many reflection image materials (typical of which are color papers) contain 1 to 2.5 g of silver per 1 $m^2$ of the sensitive material, and many photographing materials such as color negative films and color reversal films contain 3 to 9 g of silver per 1 $m^2$. This quantity of silver is necessary to obtain a desirable color image density, but it is preferred to reduce the quantity of silver from the standpoint of saving silver source as well as reducing production costs.

U.S. Pat. No. 3,674,490 describes a method whereby the quantity of a silver halide in a light-sensitive material can be reduced by a color intensification. According to this specification, an image-wise distributed metallic image acts as a catalyst to activate a peroxide such as hydrogen peroxide and an oxidation reaction is thus carried out to form a dye and a color image. Since such a metallic image is present as a catalyst, the quantity thereof may be very small. In the case where the metal image is silver, therefore, a desirable color density can be provided with a lessened quantity of silver salt than the quantity of silver salt used in a gelatino-silver salt emulsion of the prior art. In this method, a peroxide is used in an intensification step after the development, that is, color development. However, this method has many disadvantages, for example, a peroxide such as hydrogen peroxide is very unstable in aqueous solution. Stabilization of aqueous hydrogen peroxide can be accomplished by the addition of sodium pyrophosphate or sodium stannate as a stabilizer as described in "Research Disclosure" 11660 or W. C. Schumb: "Hydrogen Peroxide" page 515–547. Furthermore, marked fog occurs due to intensification.

SUMMARY OF THE INVENTION

It is one object of the present invention to prevent fog formation when an image is formed by intensification using hydrogen peroxide or a compound capable of releasing hydrogen peroxide.

The above described object is attained by a method of forming an image which comprises subjecting a photographic element comprising a support and at least one photographic layer in which there is image-wise distributed a substance having a catalytic action to image intensification in the presence of a reducing agent using a solution containing (1) at least one of a halogenite, hydrogen peroxide and a compound(s) capable of releasing hydrogen peroxide, and (2) at least one nitro-substituted nitrogen-containing heterocyclic compound represented by the following General Formulae (I) or (II), (I)

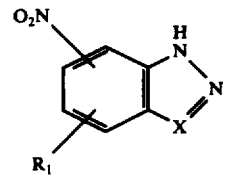

(II)

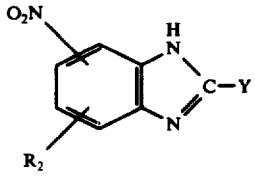

in which $R_1$ represents hydrogen atom, a lower alkyl group, most preferably having 1 to 5 carbon atoms, $SO_3M$ or COOM wherein M represents an alkali metal or ammonium ion, X represents a nitrogen atom or CR', where R' represents a hydrogen atom or a lower alkyl group, $R_2$ represents a hydrogen atom, a lower alkyl group, most preferably having 1 to 5 carbon atoms, $SO_3M$ or COOM, where M is above defined, Y represents a hydrogen atom, an alkyl group, most preferably having 1 to 5 carbon atoms, or $—CH_2—S—(CH_2)_n$-Y', where $n$ represents an integer of from 1 to 3 and Y' represents hydrogen atom or $SO_3M$ where M is as above defined.

DETALIED DESCRIPTION OF THE INVENTION

As known antifoggants, there are halides such as potassium bromide and potassium iodide and organic antifoggants such as benzotriazole and 1-phenyl-5-mercaptotetrazole. However, when a halide is added to an intensification bath comprising hydrogen peroxide, a marked lowering of image density occurs, and, according to the quantity added, there may be no intensification effect, while 1-phenyl-5-mercaptotetrazole has only a low antifogging effect, and, while benzotriazole has an antifogging effect, it results in a considerable decrease in image density.

We found, as a result of various studies, that the nitro-substituted nitrogen-containing heterocyclic compounds represented by the above described general formulae are most suitable for the purpose of the present invention.

The nitro-substituted nitrogen-containing heterocyclic compounds represented by the above described general formulae are known material and can be synthesized by the methods described $n$, for example, West German Patent Applications (OLS) 2,206,299 and 1,952,253.

Examples of compounds suitable for use in the present invention are as follows:

6-Nitroisoindazole

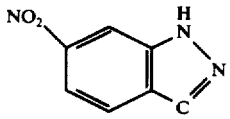

5-Nitroisoindazole

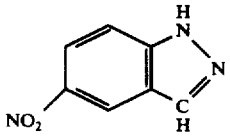

3-Methyl-5-Nitrosoindazole

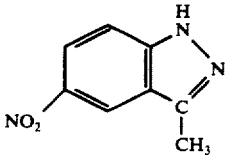

5-Nitrobenzimidazole

-continued

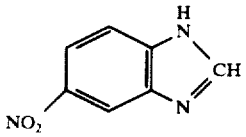

2-Ethyl-5-Nitrobenzimidazole

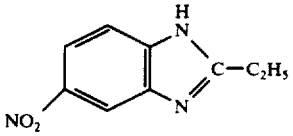

2-n-Amyl-5-Nitrobenzimidazole

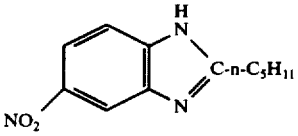

5-Nitrobenztriazole

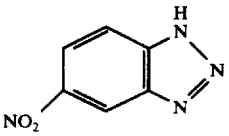

2-(γ-Sulfo)propylthiomethyl-5-Nitrobenzimidazole

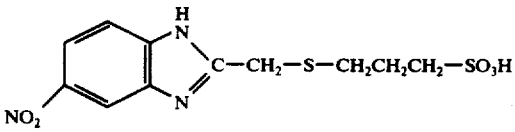

The quantity of the nitro-substituted nitrogen-containing heterocyclic compound added according to the present invention is about $1 \times 10^{-5}$ to about $1 \times 10^{-2}$ mol, preferably $1 \times 10^{-4}$ to $5 \times 10^{-3}$ mol, per 1 liter of the intensification solution.

The intensification solution is a solution containing a halogenite hydrogen peroxide or a compound capable of releasing hydrogen perioxide. When the nitro-substituted nitrogen-containing heterocyclic compound of the invention is added to such an intensification solution, fog is remarkably decreased and the maximum density is not lowered at all or is hardly lowered.

As occassion demands, these compounds can be added to a light-sensitive layer or light-non-sensitive photographic auxiliary layer of a light-sensitive material.

In the present invention, hydrogen peroxide or a compound capable of releasing hydrogen perioxide is used as an intensifying agent. Examples of the compound capable of releasing hydrogen peroxide are hydrogen peroxide compounds such as $Na_2SiO_3.H_2O_2H_2O$ and $NaBO_2.H_2O_2.3H_2O$ and peroxo compounds such as peroxocarbonate, peroxoborate, peroxosulfate and peroxophosphate. A halogenite such as sodium chlorite can also be used as the intensifying agent.

The halogenite, hydrogen peroxide or a compound capable of releasing hydrogen peroxide in an intensifier is used in a concentration of about 1 to about 300 g/l, more preferably, 5 to 100 g/l.

The intensifier has a pH of about 7 to about 14, preferably 8 to 11.

The high activity intensifying agent according to the present invention comprising halogenites such as sodium chloride, hydrogen peroxide and/or compounds capable of releasing hydrogen peroxide can be added to light-sensitive materials (light-sensitive photographic emulsion layers, light-non-sensitive photographic auxiliary layers, etc.) together with stabilizers or using precursors of the intensifying agent, for example, according to the method described in U.S. Pat. No. 3,765,890.

Into the intensifier there can be incorporated known compounds for developers since similar reactions occur in an intensifying bath and in a developing bath, with examples of such known compounds for developers including alkaline agents amd buffering agents such as sodium hydroxide, potassium hydroxide, sodium carbonate, potassium carbonate, sodium phosphate, potassium phosphate, potassium metaborate and borax, individually or in combination. Furthermore, for the purpose of providing buffering capability, ease of preparation or raising ionic strength, various salts can be used such as disodium hydrogen phosphate, dipotassium hydrogen phosphate, sodium dihydrogen phosphate, potassium dihydrogen phosphate, sodium hydrogen carbonate, potassium hydrogen carbonate, alkali borates, alkali nitrates and alkali sulfates.

In addition, as a hydrogen peroxide stabilizer, there can be used acids such as boric acid, gallic acid, uric acid, barbituric acid, salicylic acid, benzoic acid and sulfanilic acid, sodium phosphates such as sodium pyrophosphate, sodium dihydrogen phosphate, sodium hypophoshite, sodium metaphosphate and various sodium polyphosphates and other known compounds such as sodium stannate, 8-oxyquinoline, acetanilide, urea, ethylenediaminetetraacetic acid and diethylenetriaminepentaacetic acid. The stabilizer is usually added in an amount of 1 to 100 weight percent of the hydrogen peroxide.

If desired or necessary, to the intensifier there can be added a development accelerator, for example, neutral salts such as thallium nitrate and potassium nitrate, cationic dyes such as phenosafranine and pyridinium compounds or other cationic compounds as described in U.S. Pat. No. 2,648,604, Japanese Patent Publication 9503/1969 and U.S. Pat. No. 3,671,247, nonionic compounds such as polyethylene glycol or derivatives thereof and polythioethers as described in Japanese Patent Publication 9504/1969 and U.S. Pat. Nos. 2,533,990, 2,531,832, 2,950,970 and 2,577,127, organic amines such as ethanolamine, ethylenediamine and diethanolamine and organic solvents as described in Japanese Patent Publication 9509/1969 and Belgian Pat. No. 682,862 and those described in L.F.A. Mason: "Photographic Processing Chemistry" page 40 to 43 (Focal Press London 1966).

Examples of other effective development accelerators are phenylethyl alcohol and benzyl alcohol as described in U.S. Pat. No. 2,515,147 and hydrazine, ammonia, amines and pyridine as described in "Nippon Shashin Gakkai-Shi" Vol, 14, page 74 (1952).

Hydroxylamine hydrochloride, hydroxylammonium sulfate, sodium sulfate, potassium sulfite, postassium hydrogen sulfite and sodium hydrogen sulfite can also be used, if desired.

As water softeners, there can be used polyphosphoric acid compounds such as sodium hexametaphosphate, sodium tetrapolyphosphate and sodium tripolyphosphate or potassium salts of the above described phosphoric acids and aminopolycarboxylic acids such as ethylenediaminetetraacetic acid, nitrilotriacetic acid, cyclohexanediaminetetraacetic acid, iminodiacetic acid, N-hydroxymethylethylenediaminetriacetic acid and diethylenetriaminepentaacetic acid. The quantity of the water softener added depends on the hardness of water, and is ordinarily about 0.5 to about 1 g/l. In addition, calcium or magnesium masking agents can be used in photographic processing solutions as described in J. Willems: "Belgisches Chemiches Industry", Vol. 21, page 325 (1956) and Vol. 23, page 1105 (1958). These water softeners can also be used as hydrogen peroxide stabilizers.

Examples of useful reducing agents in the present invention are p-phenylenediamine derivative color developers, p-aminophenol derivative color developers to be onium salts as described in U.S. Pat. No. 3,791,827, including ammonium, oxonium, phosphonium, sulfonium and carbonium compounds, color developers as described in U.S. Pat. No. 2,983,606, diffusible dye releasing type (DDR) redox compounds as described in Japanese Patent Application (OPI) 33,826/1973, developing agents capable of forming dyes through reaction with amidorazone compounds as described in Japanese Patent Publication 39,165/1973, reducing agents of the type forming lakes or dyes via self-oxidation such as tetrazonium salts, 2,4-diaminophenol, $\alpha$-nitroso-$\beta$-naphthol and leuco dyes and reducing agents capable of forming a colored image after oxidation as described in Japanese Patent Application (OPI) 6,338/1972, pages 9 to 13.

Those reducing agents are classified into those where the reducing agent is a developing agent and is oxidized and coupled with a color former to form a dye, where the reducing agent itself is oxidized to form a dye or where the reducing agent is previously colored and releases a non-diffusible dye through oxidation. The reducing agent of the present invention can be present in a processsing solution and/or light-sensitive material. The processing solution means a developer or intensifier. When the reducing agent is incorporated in a light-sensitive material, the silver halide emulsion layer is preferably chosen, though examples of other layers in which the reducing agent can be incorporated include an intermediate layer and a protective layer.

Typical examples of the p-phenylenediamine derivative color developers include N,N-diethyl-p-phenylenediamine hydrochloride, 2-amino-5-diethylaminotoluene hydrochloride, 2-amino-5-(N-ethyl-N-laurylamino)toluene, 4-(N-ethyl-N-($\beta$-hydroxyethyl)-amino)aniline sulfate, 2-methyl-4-(N-ethyl-N-($\beta$-hydroxyethyl)-amino)aniline sulfate, N-ethyl-N-($\beta$-methanesulfonamidoethyl)-3-methyl-4-aminoaniline sesquisulfate monohydrate as described in U.S. Pat. No. 2,193,015, N-(2-amino-5-diethylaminophenylethyl)methanesulfonamide sulfate as described in U.S. Pat. No. 2,592,364, N,N-dimethyl-p-phenylenediamine hydrochloride, 4-amino-3-methyl-N-ethyl-N-methoxyethylaniline, 4-amino-3-methyl-N-ethyl-N-$\beta$-ethoxyethylaniline, 4-amino-3-methyl-N-$\beta$-butoxyethylaniline and their salts (e.g., sulfates, hydrocholorides, sulfites, p-toluenesulfonates, etc.) described in U.S. Pat. Nos. 3,656,950, and 3,698,525. In addition, the p-phenylenediamine derivative color developers include those described in "Kagaku Shashin Binran" (published by Maru Zen Shuppansha, 1959), Vol. II, page 72 and L.F.A. Mason: "Photographic Processing Chemistry" published by Focal Press, London, (1966), pages 226–229.

When this reducing agent is used, it is necessary to incorporate in an image-forming material or a processing solution a coupler as is disclosed in Mees and James: "The Theory of Photographic Processes", Ed. III, pages 387-392.

As the reducing agent, a p-aminophenol derivative can be used, preferably a p-aminophenol derivative having a primary amino group (for example, p-aminophenol). In this case, image formation is also carried out in the presence of the above described coupler. Typical examples of reducing agents of this kind are p-aminophenol sulfate, etc.

As the reducing agent, there are those of the type where the reducing agent itself is oxidized to form a color image or forms a complex with a metal salt. Examples of reducing agents belonging to this type are developing agents as described in British Pat. No. 1,210,417, tetrazonium salts as described in U.S. Pat. No. 3,665,382, 2,4-diaminophenol, $\alpha$-nitoroso-$\beta$-naphthol and the like.

These reducing agents include various known tanning developers such as pyrogallol, catechol, 4-phenylpyrocatechol and chlorohydroquinone, which have the effect of image-wise hardening a gelatin film when oxidized by a halogenite, hydrogen peroxide or a compound capable of releasing hydrogen peroxide. In addition, all the reducing agents described in U.S. Pat. No. 3,674,490 can be used in the present invention.

General examples of an image-wise distributed material having a catalytic action are latent images, centers of development or partly or completely developed silver formed in a silver salt light-sensitive material. Such a material may be an image-wise noble metal obtained by treating and intensifying a latent image with a solution of gold salt or platinum salt or it may be a silver image transferred from a light-sensitive material to an image receiving material by the silver salt diffusion transfer method. Further, it may be an image-wise metal obtained by treating and intensifying a latent image formed on a photoconductive material such as titanium oxide or zinc oxide with a noble metal compound such as silver salts or gold salts, for example, silver nitrate and gold chloride. Moreover, it may be a zero valency metal selected from Group IB and VIII elements or a sulfide thereof. Of these materials, more effective materials are platinum, palladium, copper, silver, gold, mercury, copper sulfide and silver sulfide. Nickel may also be used, if desired. The size of the catalytic nuclei is not overly important, and is merely selected in accordance with those conventionally used in the art.

The reducing agent is a compound which is oxidized by a halogenite, hydrogen peroxide or a compound capable of releasing hydrogen peroxide, such as percarbonates or perborates, in the presence of an image-wise distributed material having a catalytic action but which is oxidized only at a very slow rate in a areas where there is no material having a catalytic action. The reducing agent also has the effect of forming an image via self-oxidation or the oxidized form of the reducing agent reacts with a color former to form an image.

In general, photographic materials contain 3 to 10 g/m$^2$ of a silver salt as silver, and even printing materials contain 1 to 4 g/m$^2$ of silver. In the photographic material of the invention, on the other hand, the quantity of coated silver may be less than about 5 g/m$^2$, particularly, less than 3 g/m$^2$. It is most preferred that the amount of silver be more than about 1 mg/m$^2$, however. In the case of a multi-layer photographic light-sensitive material, the quantity of coated silver is less than 2 g/m$^2$ per one light-sensitive layer, particularly, 1 g/m$^2$ to 1 mg/m$^2$.

The color former used in the present invention is a compound capable of forming a dye through reaction with an oxidized color developing agent. Examples of the color former are couplers commonly used in color light-sensitive materials such as open chain ketomethylene type couplers, 5-pyrazolone type couplers, indazolone type couplers and phenol or naphthol type couplers, diffusible dye releasing (DDR) type couplers capable of releasing a diffusible dye through reaction with a color developer as described in British Patent 840,731, U.S. Pat. No. 3,227,550, Japanese Patent Application (OPI) 123,022/1974 and Japanese Patent Application 57,040/1975 and amidorazone compounds capable of releasing a diffusible dye through reaction with the oxidized product of a developing agent as described in Japanese Patent Publication 39,165/1973.

In a typical embodiment of this invention, a color forming coupler is incorporated in a light-sensitive material in a quantity sufficient to give the desired color density. The coupler is ordinarily used in a quantity of equimolar or more that of the silver present. As the coupler, any material can be chosen from known couplers. Such couplers have a structure which renders them non-diffusible to another layer during production or processing.

Examples of couplers used in the present invention include the following. As yellow couplers, there can be used open chain ketomethylene type compounds, for examples, as described in U.S. Pat. Nos. 3,341,331, 2,875,057 and 3,551,155, West German Patent Application (OLS) 1,547,868, U.S. Pat. Nos. 3,265,506, 3,582,322 and 3,725,072, West German Patent Application (OLS) 2,162,899, U.S. Pat. Nos. 3,369,895 and 3,408,194 and West German Patent Application (OLS) 2,057,941, 2,213,461, 2,219,917, 2,261,361 and 2,263,875.

As the magenta coupler, 5-pyrazolone compounds are mainly used, but indazolone compounds and cyanoacetyl compounds can be used, as described in U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Applications 21,454/1973 and 56,050/1973, German Pat. No. 1,810,464, Japanese Patent Publication 2016/1969, Japanese Patent Application 45,971/1973 and U.S. Pat. No. 2,983,608.

As cyan couplers, phenol or naphthol derivatives are mainly used as are described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971, West German Patent Application (OLS) 2,163,811, Japanese Patent Publication 28,836/1970 and Japanese Patent Application 33,238/1973.

In addition, couplers capable of releasing a development inhibitor during color forming reaction (so-called DIR couplers) or compounds capable of releasing a development retarding compound can be added. Examples of these compounds are described in U.S. Pat. Nos. 3,148,062, 3,227,554, 3,253,924,3,622,328 and 3,705,201, British Pat. No. 1,210,110 and U.S. Pat. Nos. 3,297,445, 3,379,529 and 3,639,417.

As to the above described couplers, two or more of them can jointly be used in a same layer to satisfy the requirements for the light-sensitive material or the same compound can be added to two or more layers.

The color former used in the present invention is dissolved in a known solvent for a color former, preferably, a polar solvent, and then added to the unit layer. Useful examples of the solvent are tri-o-cresyl phosphate, trihexyl phosphate, dioctyl butyl phosphate, dibutyl phthalate, diethyllaurylamide, 2,4-diallylphenol and liquid dye stabilizers as are described in "Improved photographic dye image stabilizing solvents" in "Product Licensing Index", Vol. 83, page 26–29 (March 1971). An element containing a solvent for a color former may promote the absorption of a color developer while the element is transferred from a developer bath to an intensifier bath.

It is desirable that the maximum absorption band of a cyan dye formed from a cyan color former be between about 600 to about 720 nm, that of a magenta dye formed from a magenta color former be between about 500 to about 580 nm and that of a yellow dye formed from a yellow color former be between about 400 to about 480 nm.

The silver halide emulsion is ordinarily prepared by mixing a solution of a water-soluble silver salt such as silver nitrate and a solution of a water-soluble halide such as potassium bromide in the presence of a solution of a water-soluble high molecular weight material such as gelatin. As the silver halide, there can be used silver chloride, silver bromide and mixed silver halides such as silver chlorobromide, silver iodobromide and silver chloroiodobromide. The crystal form of these silver halide grains may be cubic, octahedral or a mixed form thereof. Two of more silver halide photographic emulsions prepared individually may be mixed. The crystal structure of a silver halide grain may be uniform throughout or may be laminar in structure wherein the shell and core are different or may be of the conversion type as described in British Pat. No. 635,841 and U.S. Pat. No. 3,622,318. Furthermore, such a photographic emulsion may be of the type where a latent image is mainly formed on the surface of the grains or of the type where a latent image is formed inside the grains. These photographic emulsions are described in Mees: "The Theory of the Photographic Process" published by MacMillan Co. and P. Glafkides: "Chimie Photographique" published by Paul Montel Co. (1957), which can be prepared by the commonly used ammonia method, neutral method or acidic method.

The above described silver halide emulsions can be chemically sensitized in a known manner, if desired. Examples of such chemical sensitizers are gold compounds such as chloroaurates and gold trichloride as described in U.S. Pat. Nos. 2,399,083, 2,540,085, 2,597,856 and 2,597,915, salts of noble metals such as platinum, palladium, iridium, rhodium and ruthenium as described in U.S. Pat. Nos. 2,448,060, 2,540,086, 2,566,245, 2,566,263 and 2,598,079, sulfur compounds capable of forming silver sulfide through reaction with silver salts, as described in U.S. Pat. Nos. 1,574,944, 2,410,689, 3,189,458 and 3,501,313 and stannous salts, amines and other reducing materials as described in U.S. Pat. Nos. 2,487,850, 2,518,698, 2,521,925, 2,521,926, 2,694,637, 2,983,610 and 3,201,254.

In some cases, various additives are preferably added to photographic elements so as to obtain desirable development properties, image properties and film properties. As these additives, there are iodides in salt form and organic compounds having a free mercapto radical, for example, alkali metal iodides and phenylmercaptotetrazole. However, the use of these additives in large amounts should be avoided.

Antifoggants as are generally added to a light-sensitive silver halide emulsion layer or a non-sensitive auxiliary layer of a photographic element can be used together with the compounds represented by the general formula according to the present invention. Other additives for photographic elements include hardeners, plasticizers, lubricants, surface agents, lustering agents and known additives in the field of photography.

Examples of the hydrophilic colloid are gelatin, colloidal albumin, casein, cellulose derivatives such as carboxymethyl cellulose and hydroxyethyl cellulose, agar, sodium alginate and sugar derivatives such as starch derivatives. Examples of the synthetic hydrophilic colloid are polyvinyl alcohol, poly-N-vinylpyrrolidone, polyacrylic acid copolymers, polyacrylamides and derivatives thereof or partially hydrolyzed products thereof. If desired or necessary, two or more miscible mixtures of these colloids can be used. The most generally used colloid is gelatin, but a part or all of the gelatin can be replaced by a synthetic high molecular weight material or a so-called gelatin derivatives can be used.

Any photographic emulsion can, if desired or necessary, be subjected to spectral sensitization or supersensitization using one or more cyanine dyes such as cyanine, merocyanine and carbocyanine dyes or the same can be used in combination with a styryl dye. Such color sensitization techniques are known and described in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, West German Patent Applications (OLS) 2,030,326 and 2,121,780, Japanese Patent Publications 4936/1968, 14,030/1969 and 10,773/1968, U.S. Pat. Nos. 3,511,664, 3,522,052, 3,527,641, 3,615,613, 3,615,632, 3,617,295, 3,635,721 and 3,694,217, and British Pat. Nos. 1,137,580 and 1,216,203. Selection of these dyes can be suitably carried out according to the object or end use of the light-sensitive material, that is, the wavelength range to be sensitized, the sensitivity desired, etc.

The photographic element of the present invention comprises at least one silver halide emulsion layer on a support and, in general, has a red-sensitive silver halide emulsion layer, a green-sensitive silver halide emulsion layer and a blue-sensitive silver halide emulsion layer on a support or a red-sensitive silver halide emulsion containing a cyan image forming coupler, a green-sensitive silver halide emulsion layer containing a magenta image forming coupler and a blue-sensitive silver halide emulsion layer containing a yellow image forming coupler on a support. In this photographic element there can be provided a non-light sensitive photographic layer such as an antihalation layer, an intermediate layer to prevent color mixing, a yellow filter layer, a protective layer, etc.

A red-sensitive layer, a green-senstive layer and a blue-sensitive layer can be arranged in any desired order, for example, in the order of the red-sensitive layer, the green-sensitive layer and the blue-sensitive layer from the support; the blue-sensitive layer, the red-sensitive layer and the green-sensitive layer from the support; or the red-sensitive layer, the green-sensitive layer and the blue-sensitive layer from the support. Furthermore, the photographic element of this invention can be provided with an emulsion layer consisting of a plurality of unit emulsions or with various layer structures, as described in U.S. Pat. Nos. 3,726,681 and 3,516,831, British Pat. Nos. 818,687 and 923,045 and Japanese Patent Applications 5,179/1975 and 42,541/1975.

As the photographic support, there can be used any materials as are ordinarily used in photographic light-sensitive materials, for example, cellulose nitrate films, cellulose acetate films, cellulose acetate butyrate films, cellulose acetate propionate films, polystyrene films, polyethylene terephthalate films, polycarbonate films or laminates thereof, thin glass films and papers. Furthermore, good results are also given by the use of papers coated or laminated with baryta or α-olefin polymers, in particular, a polymer of an α-olefin having 2 to 10 carbon atoms such as polyethylene, polypropylene an ethylene-butene copolymer, or a plastic film coarsened to increase its adhesiveness to other high molecular materials as is shown in Japanese Patent Publication 19,068/1972.

These support members can be chosen from transparent or opaque materials, depending on the object or proposed end use of the light-sensitive material. In the case of transparent materials, not only transparent colorless materials but also transparent materials colored with dyes or pigments can be used. Such have hitherto been used for X-ray films and are described in J. SMPTE 67, 296 (1958).

Useful opaque supports include not only inherently opaque materials such as papers, transparent films heavily dyed or pigmented with, for example, titanium dioxide, plastic films surface-treated by the method as described in Japanese Patent Publication 19,068/1972 but papers or plastic films rendered completely opaque by the addition of carbon black or a dye. Sometimes a layer having good adhesion to both a support and a photographic emulsion layer is provided as an undercoated layer. The surface of the support can also be subject to corona discharge, ultraviolet ray radiation treatment or flame treatment as a pretreament, if desired.

The photographic element of this invention consists of a support and a dye image providing unit layer provided thereon. A multicolor photographic element has at least two dye image feeding unit layers, each layer recording spectral radiation in a different wavelength region. The unit layer contains a light-sensitive silver salt which, in general, is spectrally sensitized to radiation in a certain wavelength region, in combination with a photograhic color former. The layers which yield different colors are effectively separated by a barrier layer, a spacer layer or a layer containing an agent which removes an oxidized developer to prevent color contamination between different dye image providing unit layers. Effective methods of separating unit layers are well known in the art and are used to prevent such contamination in a number of commercial color articles. Furthermore, light-sensitive materials having a development contamination preventing layer as are described in U.S. Pat. No. 3,737,317 and Japanese Patent Applications 73,445/1973 and 113,633/1973 can be used in the present invention, if desired.

The photographic element layer used in the present invention can be coated by various methods, for example, immersion coating, air knife coating, curtain coating and extrusion coating using a hopper of the type as described in U.S. Pat. No. 2,681,294.

If desired, two or more layers can simultaneously be coated by the methods as described in U.S. Pat. No. 2,761,791 and 3,508,947 and British Pat. No. 837,095. The photographic element of the invention can be designed for color image transfer methods as described in U.S. Pat. Nos. 3,087,817, 3,185,567, 2,983,606, 3,253,915, 3,227,550, 3,227,551, 3,227,552, 3,145,633, 3,415,645 and 3,415,646 or for absorption transfer methods as described in U.S. Pat. No. 2,882,156. When a color former of a "previously" dye forming type or a color former of an oxidation-reduction dissociation type as is disclosed in the above patents is used in the element, at least two color image providing unit layers contain such a color former in a quantity of at least 40% more than the stoichiometric quantity based on the silver in the layers.

Into a developer used in the present invention there can be incorporated one or more developing agents (reducing agents) as described above. As the developer component compound, all the developer component compounds can be used, which can be contained in the intensifier described above.

In addition, the following compounds can, if desired or necessary, be added to a color developer. For example, competitive couplers such as citrazinic acid, J acid and H acid, as described in Japanese Patent Publications 9,505/1969, 9,506/1969, 9,507/1969, 14,036/1970 and 9,508/1969 and U.S. Patents 2,742,832, 3,520,690, 3,560,212 and 3,645,737, fogging agents such as alkali metal borohydrides, aminoboranes and ethylenediamine as described in Japanese Patent Publication 38,816/1972, and compensation developers such as p-aminophenol, benzyl-p-aminophenol and 1-phenyl-3-pyrazolidone as described in Japanese Patent Publications 41,475/1970, 19,037/1971 and 19,438/1971. These compensation developers are ordinarily added in a proportion of 0.1 to 1.0 g/l.

In one typical process according to the present invention, a silver halide color light-sensitive material is developed, intensified, bleached, fixed (or bleach-fixed), washed with water and dried to give a color image. Also, after intensifying, the color element may be washed with water and then bleached, if desired. In another process, a color image is provided by incorporating a developing agent in an emulsion layer or a layer adjacent thereto and then treated with an intensifier containing a compound capable of releasing hydrogen peroxide (such as percarbonates or perborates or hydrogen peroxide) to thus simultaneously effect development and intensification without treatment with a developer, followed by bleaching, fixing, or bleach-fixing, washing with water and drying to give a color image.

In a further process, a sensitive material havingl a developing agent in the emulsion layer or adjacent layer is treated with an intensifier containing a fixing agent, whereby a mono- bath development, intensification and fixing can be carried out, followed by rinsing and drying. As a modification of this process, a mono- bath development, intensification and stabilization can be carried out without water washing or rinsing.

In a still further process, a sensitive material is developed, intensified and fixed without bleaching, followed by washing with water and drying. This process is suitable for X-ray sensitive materials.

When using a sensitive material having a particularly small quantity of silver, a treatment can be carried out which comprises developing, intensifying, washing with water and drying.

In a further process, a coupler can be incorporated in the developer. Examples of such diffusible external couplers added to a developer are cyan couplers, for example, as described in U.S. Pat. Nos. 3,002,836 and 3,542,552, magenta couplers, for example, as described in Japanese Patent Publication 13,111/1969 and yellow couplers, for example, as described in U.S. Patent 3,510,306. In this case, such a coupler is used in a concentration of 0.51 to 5 g/l, preferably 1 to 2.5 g/l.

In a further process, a light-sensitive layer and an image receiving layer are superimposed, between which a developer is introduced to effect development, and a dye which is rendered diffusible by oxidation with hydrogen peroxide or a compound capable of releasing hydrogen peroxide (such as a percarbonate or perborate) is diffused to the image receiving layer. Conversely, a diffusible dye can be received from nonoxidized areas.

In a further embodiment of the invention, a gelatino silver salt light-sensitive material, typically a gelatino silver halide, is exposed and then developed with a tanning developer, during which gelatin crosslinking (tanning) is strengthened in exposed areas by a halogenite, a peroxide such as hydrogen peroxide or a hydrogen peroxide-releasing compound contained in the light-sensitive material. Thereafter, the light-sensitive material is fixed or not fixed and washed with warm water to form a relief image.

In a color system, a dye image of the subtractive color type can be formed by a color negative method such as is described in W. T. Hanson and W. I. Kesner: "Journal of the Society of Motion Picture and Television Engineers" Vol. 61 (1953), page 667–701, or a color reversal method comprising image-wise exposing using a direct positive emulsion or negative emulsion, developing in a black-and-white developer to form a negative silver image, further exposing at least one time (or subjecting to another suitable fogging treatment) and then developing to form a desirable color image of the subtractive color type can be used. In this case, bleaching is generally carried out after the black-and-white development to prevent the first developed silver from acting as a catalyst, and intensification is carried out after the color development.

The method of the invention is feasibly practiced at any temperature, but is ordinarily carried out at 10° to 70° C, particularly 20° to 60° C.

The method of the invention is superior to the prior art methods at the following points: first, metallic nuclei, such as silver, act only as an oxidation-reduction catalyst and are thus effective in small quantities so the quantity of the metal, such as silver or a metal salt such as silver halide, etc., can markedly be reduced; second, according to the present invention fog can be markedly decreased without lowering the intensifying effect as compared with the prior art intensification of peroxides; and, third, image intensification can be accomplished with an improved intensifying effect as compared with the cobalt intensification of the prior art.

In accordance with the present invention, on commercial scale operation it is preferred that the reducing agent be used in an amount of from about $1 \times 10^{-3}$ to about $1 \times 10^{-1}$ mol/liter, even more preferably from $5 \times 10^{-3}$ to $5 \times 10^{-2}$ mol/liter, of the processing solution in which it is contained.

The present invention will now be illustrated in detail by the following examples without limiting the same. In the following Examples, all percentages are weight percentages except where indicated to be mol percentages.

EXAMPLE 1

A photographic element was prepared from the following element (1) to (7) in the recited order:

1. Paper support coated with polyethylene;
2. Blue-sensitive silver chlorobromide emulsion (silver chloride: 20 mol %) layer containing 600 mg/m² of a yellow coupler, α-pivaloyl-α-(2,4-dioxo-5,5-dimethyloxazolidine-3-yl)-2-chloro-5-[α-(2,4-di-t-amylphenoxy)butaneamido]acetanilide, dispersed in 150 mg/m² of silver, 1500 mg/m² of gelatin and 300 mg/m² of dioctylbutyl phosphate;
3. Layer containing 1000 mg/m² of gelatin
4. Green-sensitive silver chlorobromide emulsion (silver chloride: 70 mol %) layer containing 350 mg/m² of a magenta coupler, 1-(2,4,6-trichlorophenyl)-3-[(2-chloro-5-tetradecaneamido)-anilino]-2-pyrazoline-5-one, dispersed in 100 mg/m² of silver, 800 mg/m² of gelatin and 170 mg/m² of tricresyl phosphate;
5. Layer containing 100 mg/m² of gelatin, 50 mg/m² of an ultraviolet ray absorber and 50 mg/m² of dioctylhydroquinone
6. Red-sensitive silver halide emulsion (silver chloride: 70 mol %) layer containing 300 mg/m² of a cyan coupler, 2-[α-(2,4-di-t-amylphenoxy)butaneamido]-4,6-dichloro-5-methylphenol, dispersed in 100 mg/m² of silver, 700 mg/m² of gelatin and 150 mg/m² of n-butyl phthalate;
7. Layer containing 100 mg/m² of gelatin.

This photographic element was exposed by means of an actinometer (2854° K, 500 CMS, 1 second) and then subjected to the following treatment:

| | | | |
|---|---|---|---|
| Treatment | | | |
| Color Development | 40° C | 1 minute | |
| Intensification | " | " | |
| Water Washing | 26° C | | 30 seconds |
| Bleaching and Fixing | 40° C | 1 minute | |
| Water Washing | 26° C | 1 minute | 30 seconds |
| Drying | | | |
| Compositions of the Treating Solutions | | | |
| Color Developer | | | |
| Benzyl Alcohol | | 15 ml | |
| Potassium Carbonate | | 30 g | |
| Potassium Bromide | | 0.4 g | |
| Hydroxylamine Sulfate | | 2 g | |
| Potassium Sulfite | | 4 g | |
| Diaminopropanoltetraacetic Acid | | 3 g | |
| N-Ethyl-N-Methoxyethyl-3-Methyl-p-Phenylenediamine Di-p-toluenesulfonate | | 7.5 g | |
| Water to make | | 1000 ml (pH = 10.1) | |
| Basic Intensifier Composition | | | |
| Hydrogen Peroxide Solution (30%) | | 30 ml | |
| Disodium Phosphate (12 Hydrate) | | 36 g | |
| Sodium Pyrophosphate (7 Hydrate) | | 1 g | |
| Sodium Stannate | | 0.1 g | |
| Water to make | | 1000 ml (pH = 9.0) | |
| Antiffogant | | As shown below | |

An antifoggant was added to five samples the above described intensifier to prepare the following five intensifiers:

| No. | Antifoggant | Quantity |
|---|---|---|
| 1 | None | — |
| 2 | Potassium Bromide | $1 \times 10^{-3}$ mol/l |
| 3 | Benzotriazole | " |
| 4 | 1-Phenyl-5-Mercaptotetrazole | " |
| 5 | 5-Nitrobenzotriazole | " |
| Bleaching and Fixing Solution | | |
| Ammonium Thiosulfate (70%) | | 150 ml |
| Sodium Sulfite | | 5 g |
| Na(Fe(EDTA))* | | 40 g |
| EDTA** | | 4 g |

-continued

| | |
|---|---|
| Water to make | 1,000 ml |

*Ethylenediamine tetraaceticacid-Fe-complex sodium salt,
**Ethylenediamine tetraacetic acid, Intensifiers 1 to 4 were prepared for comparison and Intensifier No. 5 is one of the present invention. The resulting photographic properties are tabulated below:

| | Fog | | | Maximum Density | | | Relative Sensitivity | | |
|---|---|---|---|---|---|---|---|---|---|
| No. | R | G | B | R | G | B | R | G | B |
| 1 | 0.24 | 0.18 | 0.47 | 2.42 | 2.14 | 2.32 | 100 | 100 | 100 |
| 2 | 0.12 | 0.11 | 0.16 | 2.35 | 1.51 | 2.01 | 65 | 55 | 65 |
| 3 | 0.12 | 0.09 | 0.16 | 2.37 | 1.82 | 2.18 | 80 | 70 | 60 |
| 4 | 0.20 | 0.16 | 0.38 | 2.38 | 1.95 | 2.16 | 95 | 90 | 85 |
| 5 | 0.12 | 0.10 | 0.16 | 2.45 | 2.20 | 2.32 | 105 | 100 | 95 |

R, G and B = red, green, and blue respectively

Potassium bromide (No.2 for comparison) and benzotriazole (No. 3, for comparison) decreased fog, but the sensitivity and maximum density were also lowered to a great extent. 1-phenyl-5-mercaptotetrazole (No. 4, for comparison) gave only a small fog inhibiting effect. On the contrary, 5-nitrogenzotriazole (No. 5) of the present invention markedly decreased fog while increasing the maximum densty slightly and scarecely affecting sensitivity.

EXAMPLE 2

A photographic element was prepared comprising a paper support coated with polyethylene and a coupler dispersion obtained by dissolving, in tricresyl phosphate, 100 mg/m² of a silver chlorobromide emulsion (silver chloride 70 mol %) and 700 mg/m² of 1-(2,4,6-trichlorophenyl)-3-(2-chloro-5-tetradecaneamidoanilino)-2-pyrazoline-5-one and dispersing the same in a gelatin solution of the O/W type using sorbitan monolaurate, Turkey red oil and sodium dodecylbenzenesulfonate as emulsifying and dispersing agents, and then exposed by means of an actinometer and then subjected to the following treatment:

| | |
|---|---|
| Treatment | |
| As in Example 1 | |
| Composition of Treating Solutions | |
| Color Developer | |
| Benzyl Alcohol | 15 ml |
| Potassium Carbonate | 30 g |
| Potassium Bromide | 0.5 g |
| Hydroxylamine Sulfate | 3 g |
| Sodium Sulfite | 3 g |
| Diethylenetriaminepentaacetic Acid | 4 g |
| 4-Amino-N-Ethyl-N-(β-methanesulfonamidoethyl)-m-toluidine Sesquisulfate Monohydrate | 8 g |
| Water to make | 1000 ml (pH 10.1) |
| Basic Intensifier Composition | |
| Sodium Peroxocarbonate | 100 g |
| Sodium stannate | 0.2 g |
| Diethylenetriaminepentaacetic Acid | 1 g |
| Water to make | 1000 ml (pH = 10.0) |
| Antifoggant as shown below | |

An antifoggant was added to each of the above described intensifiers to prepare the following five intensifiers:

| No. | Antifoggant | Quantity |
|---|---|---|
| 6 | None | — |
| 7 | 5-Methylbenzotriazole | $4 \times 10^{-4}$ mol/l |
| 8 | 5-Nitrobenzimidazole | " |
| 9 | 5-Nitrobenzimidazole | " |
| 10 | 5-Nitroisoindazole | " |

Bleaching and Fixing Solution
As in Example 1.

The resulting photographic characteristics are tabulated below:

| No. | Fog | Maximum Density | Relative Sensitivity |
|---|---|---|---|
| 6 | 0.25 | 2.18 | 100 |
| 7 | 0.10 | 1.48 | 70 |
| 8 | 0.10 | 2.24 | 100 |
| 9 | 0.12 | 2.32 | 120 |
| 10 | 0.11 | 2.15 | 95 |

5-methylbenzotriazole (No. 7, for comparison) decreased fog, but the maximum density and relative sensitivity were also lowered to a great extent, while, on the contrary, 5-nitrobenzotriazole (No. 8), 5-nitrobenzimidazole (No. 9) and 5-nitroisoindazole (No. 10) of the present invention were capable of decreasing fog while increasing or only slightly decreasing the maximum density and relative sensitivity.

EXAMPLE 3

A photographic element comprising a paper support coated with polyethylene and a coupler dispersion obtained by dissolving and dispersing 100 mg/m² of a silver chlorobromide emulsion (silver chloride: 20 mol %) and 800 mg/m² of α-pivaloyl-α-(2,4-dioxo-5,5-dimethylhydantoin-3-yl)-2-chloro-5-[α-(2,4-di-t-amylphenoxy)butaneamido]acetanilide in di-n-butyl phthalate and ethyl acetate was exposed by means of an actinometer and then subjected to the treatment as in Example 1 using the intensifiers described below.

In No. 11 and No. 12, the intensifiers in No. 1 and No. 5 of Example 1 were respectively used, and in No. 13, the procedure of Example 1 was repeated except the intensifying step was omitted.

The resulting characteristics are tabulated below:

| No. | Intensifier | Antifoggant | Fog | Maximum Density | Relative Sensitivity |
|---|---|---|---|---|---|
| 11 | No. 1 | | 0.57 | 2.18 | 100 |
| 12 | No. 5 | 5-Nitrobenzotriazole | 0.15 | 2.23 | 100 |
| 13 | No Intensification | | 0.12 | 1.02 | 35 |

5-nitrobenzotriazole (No. 12) of the present invention was capable of decreasing fog to a greater extent, without lowering the maximum desnity and relative sensitivity, as compared to the case of using no antifoggant (No. 11). In the case of no intensification with hydrogen peroxide (No. 13), the maximum density and relative sensitivity were remarkably low. Antifoggant was added in an amount of $1 \times 10^{-3}$ mol/l in this example.

While the invention has been described in detail and with reference to specific embodiments thereof, it will be apparent to one skilled in the art that various changes and modifications can be made therein without departing from the spirit and scope thereof.

What is claimed is:

1. A method of forming an image which comprises subjecting an image-wise exposed and developed photographic element comprising a support and at least one photographic layer in which there is image-wise distributed a metallic silver having a catalytic effect to image-wise intensification in the presence of a reducing agent which diffuses into the layer of photographic element from the developer solution or the intensifier solution, or is previously incorporated into the layer, using a solution consisting essentially of at least one of a halogenite, hydrogen peroxide and one or more compounds capable of releasing hydrogen peroxide as an oxidation agent; and containing at least one nitro-substituted nitrogen-containing heterocyclic compound represented by the following General formulae (I) and (II);

(I)

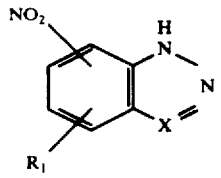

in which $R_1$ represents a hydrogen atom, an alkyl group of 1 to 5 carbon atoms, $SO_3M$ or COOM wherein M represents hydrogen atom, an alkali metal or an ammonium group, X represents nitrogen atom or CR' wherein R' represents a hydrogen atom or a lower alkyl group of 1 to 5 carbon atoms, and (II)

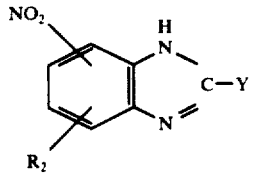

in which $R_2$ represents hydrogen atom, an alkyl group of 1 to 5 carbon atoms, $SO_3M$ or COOM wherein M represents hydrogen atom, an alkali metal or ammonium group and Y represents hydrogen atom, an alkyl group of 1 to 5 carbon atoms or $CH_2—S—(CH_2)_n—Y'$ wherein $n$ represents 1 to 3 and Y' represents a hydrogen atom or $SO_3M$.

2. The method of claim 1, which comprises the steps of development, intensification, bleaching and fixing.

3. The method of claim 1, which comprises the steps of development, intensification and blixing.

4. The method of claim 1, where material (1) is hydrogen peroxide.

5. The method of claim 1, where material (1) is a halogenite.

6. The method of claim 5, where the halogenite is sodium chlorite.

7. The method of claim 1, where material (1) is one or more compounds capable releasing hydrogen peroxide.

* * * * *